US010214787B2

(12) United States Patent
Schaefer et al.

(10) Patent No.: US 10,214,787 B2
(45) Date of Patent: Feb. 26, 2019

(54) HOT-BRIQUETTING INSTALLATION

(71) Applicant: MASCHINENFABRIK KÖPPERN GMBH & CO. KG, Hattingen (DE)

(72) Inventors: Christopher Schaefer, Hattingen (DE); Eggert De Weldige, Velbert Langenberg (DE)

(73) Assignee: MASCHINENFABRIK KOEPPERN GMBH & CO. KG, Hattingen (DE)

( * ) Notice: Subject to any disclaimer, the term of this patent is extended or adjusted under 35 U.S.C. 154(b) by 130 days.

(21) Appl. No.: 15/315,941

(22) PCT Filed: May 13, 2015

(86) PCT No.: PCT/EP2015/060691

§ 371 (c)(1),
(2) Date: Dec. 2, 2016

(87) PCT Pub. No.: WO2016/026589

PCT Pub. Date: Feb. 25, 2016

(65) Prior Publication Data

US 2017/0204485 A1 Jul. 20, 2017

(30) Foreign Application Priority Data

Aug. 20, 2014 (DE) ..... 10 2014 111 906

(51) Int. Cl.
*C21B 13/00* (2006.01)
*B30B 11/00* (2006.01)
(Continued)

(52) U.S. Cl.
CPC ..... *C21B 13/0086* (2013.01); *B30B 11/00* (2013.01); *B30B 15/0005* (2013.01);
(Continued)

(58) Field of Classification Search
CPC ..... C21B 13/0086
See application file for complete search history.

(56) References Cited

U.S. PATENT DOCUMENTS 4,533,384 A 8/1985 Rellermeyer
4,645,184 A 2/1987 Rellermeyer
(Continued)

FOREIGN PATENT DOCUMENTS

DE 3806861 B 6/1989
EP 2641981 A 9/2013
WO 2000055379 A 9/2000

*Primary Examiner* — Scott R Kastler
(74) *Attorney, Agent, or Firm* — Andrew Wilford

(57) ABSTRACT

The invention relates to a hot-briquetting or hot-compacting installation, in particular for directly reduced iron, having at least one first row (1) of presses with one or more first roll presses (2), and having at least one second row (3) of presses with one or more second roll presses (4), having at least one first cooling conveyor (7) beneath the first row (1) of presses, and a second cooling conveyor (8) beneath the second row (3) of presses, and having a plurality of material lines (6), which are assigned in each case to the individual roll presses (2, 4) and via which the briquetted or compacted material exiting from the roll presses (2, 4) is discharged to the cooling conveyors (7, 8). The material lines (6) are provided with one or more diverters (9), which can be adjusted such that the material from the roll presses (2, 4) of the first row (1) of presses and of the second row (3) of presses is discharged optionally in each case to the first cooling conveyor (7) or to the second cooling conveyor (8).

9 Claims, 2 Drawing Sheets

(51) Int. Cl.

| | |
|---|---|
| ***B30B 15/00*** | (2006.01) |
| ***C22B 1/14*** | (2006.01) |
| ***C22B 1/24*** | (2006.01) |
| ***B30B 15/32*** | (2006.01) |
| ***B30B 15/34*** | (2006.01) |

(52) U.S. Cl.
CPC ..... *B30B 15/32* (2013.01); *B30B 15/34* (2013.01); *C22B 1/14* (2013.01); *C22B 1/24* (2013.01)

(56) References Cited

U.S. PATENT DOCUMENTS

| | | | | |
|---|---|---|---|---|
| 5,630,202 | A * | 5/1997 | Bergendahl | B30B 11/16 419/66 |
| 6,074,456 | A | 6/2000 | Freytag | |
| 7,622,071 | B2 | 11/2009 | Lee | |
| 7,938,882 | B2 | 5/2011 | Metius | |
| 2006/0162499 | A1 | 7/2006 | Lee | |
| 2017/0204485 | A1 * | 7/2017 | Schaefer | B30B 11/00 |

* cited by examiner

HOT-BRIQUETTING INSTALLATION

CROSS REFERENCE TO RELATED APPLICATIONS

This application is the US-national stage of PCT application PCT/EP2015/060691 filed 13 May 2015 and claiming the priority of German patent application 102014111906.1 itself filed 20 Aug. 2014.

FIELD OF THE INVENTION

The invention relates to a hot-briquetting or hot-compacting installation, particularly for directly reduced iron, having at least one row of one or more roller presses and at least one cooling conveyor beneath the row of presses.

BACKGROUND OF THE INVENTION

Directly reduced iron, or DRI, is also referred to as iron sponge or sponge iron. It is produced through the direct reduction of iron ore. The directly reduced iron can then be further processed by hot-briquetting or hot-compacting.

In a hot-briquetting installation the directly reduced iron is pressed in one or more roller presses embodied as briquette presses into briquettes that are then suitable for transport or storage, for example. The briquettes generally emerge from the press in the form of a strand, for which reason a separator is arranged downstream that then separates the briquettes interconnected in a strand from one another.

Alternatively, in a hot-compacting installation pre-reduced or completely directly reduced iron is also pressed in a roller press, but not into briquettes; instead, compaction is (first) performed in which an extrudate emerges from the press as an intermediate product that is referred to as "slug."

This extrudate is then disaggregated, after which the material finally takes the form of a granulate that is generally processed further immediately, for example in another reduction process or in an immediately adjacent smelting furnace.

Since the material emerging from the presses has very high temperatures, the material, particularly if in briquettes, is first discharged to cooling conveyors on or in which the material is flowed around by a cooling medium, for example a liquid coolant (such as water) or a gaseous coolant.

To increase production capacity, several roller presses are generally used for briquetting or compacting.

Such an installation for hot-briquetting directly reduced iron of the type mentioned at the outset is known, for example, from WO 2000/055379. The known installation has four roller presses or four briquetting lines connected in parallel, for example, each of which is supplied from a storage bin with iron sponge in the form of fine particles via a respective "feedleg." Between two respective briquetting lines or roller presses, a bucket conveyor and hence a transport device is provided for returning fine particles separated from the product by screens beneath the briquette presses. A respective cooling conveyor belt for cooling and delivering the briquettes is provided for two briquetting lines or roller presses. Alternatively, a space-saving arrangement of four briquetting lines or roller presses in a rectangular arrangement is described. Four feedlegs go from one storage bin to the individual briquetting lines. One common screen is provided for two respective converging briquetting lines.

A line extends, in turn, from the each of the two screens to a single cooling conveyor belt that consequently receives all of the material.

An installation is known from DE 38 06 861 for transporting hot iron sponge from a direct-reduction system to the hot-briquetting system to the side of the shaft furnace. The hot-briquetting presses are located beneath a feed hopper for the material to be briquetted. They deliver the iron sponge as briquettes to screening, cooling and conveyor systems. EP 2 132 344 [U.S. Pat. No. 7,938,882] describes a method in which directly reduced iron can be delivered via supply conduits either to briquette presses or directly to a transport means. A material diverter is provided above the roller presses for this purpose. Finally, EP 2 641 981 describes an installation for manufacturing molten iron from directly reduced iron in which the directly reduced iron is compacted presses and then reduced to small pieces. The material emerging from the compacting presses or from disaggregators can either be conveyed via an upstream conveyor to a smelting furnace or stored on an interim basis in storage containers via a second conveyor. Diverters are beneath the disaggregators, so that the material can be optionally delivered to the smelting furnace on the first conveyor or to the storage container on the second conveyor. In such installations for hot-briquetting or hot-compacting directly reduced iron, the constant need exists to optimize capacity. Moreover, safety considerations are at the forefront when the installation is designed. For instance, during the processing of hot material from directly reduced iron, one must ensure that the briquettes are reliably transported away while simultaneously cooling, particularly including when system parts fail. This is where the invention comes in.

OBJECT OF THE INVENTION

It is the object of the invention to provide a hot-briquetting or hot-compacting installation, particularly for directly reduced iron, that is characterized by a high level of operational reliability. In addition, the installation is to be must have great cost-effectiveness.

SUMMARY OF THE INVENTION

To achieve this object, the invention teaches a hot-briquetting or hot-compacting installation, particularly for directly reduced iron, having at least one row of presses with one or more roller presses, at least one first cooling conveyor and one second cooling conveyor beneath the row of presses, and several material conduits associated with the individual roller presses via which the briquetted or compacted material is delivered from the roller presses to the cooling conveyors, with the material conduits being equipped with one or more diverters that can be operated such that the material is optionally delivered from the roller presses to the first or to the second cooling conveyor.

Two cooling conveyors are therefore provided according to the invention, each of which is designed such that it can individually pick up and convey the material away from the roller presses. It is thus possible during normal operation to convey the material from the presses together over both cooling conveyors. In case of a fault, for example, in the event that a cooling conveyor malfunctions, the possibility exists of conveying away, with the aid of diverters, (all of) the material via another, operable cooling conveyor. Alternatively, it is possible to work with only one cooling conveyor even in normal operation, in which case the other cooling conveyor is used only if the first cooling conveyor malfunctions. In any case, the configuration of the installation with several cooling conveyors and corresponding diverters improves the operational reliability of the installation.

Preferably, the presses are in several rows of presses, for example in a first row of presses and a second row of presses, with the first cooling conveyor being beneath the first row of presses and the second cooling conveyor beneath the second row of presses, and with the diverters being switchable such that the material can be delivered optionally from the roller presses of the first row of presses and of the second row of presses to either the first cooling conveyor or the second cooling conveyor.

Preferably, the first row of presses has several first roller presses in a line, for example successively in a straight line, and the second row of presses has several second roller presses in a line, for example successively in a straight line, with two roller presses from the first row of presses on the one hand and the second row of presses on the other hand arranged in pairs next to one another being associated with one diverter. The invention proceeds in this regard from the inherently known insight that the capacity of such an installation can be increased through the use of a plurality of roller presses, for example at least four roller presses, preferably at least six roller presses. The roller presses are preferably in at least two rows of presses. In comparison to the possible arrangement of the presses in a single row of presses, this arrangement in two rows of presses offers the advantage that the supply conduits (feedlegs) above the roller presses can be at a steeper angle than in an arrangement of the same number of presses in a single row of presses, since the angle of the feedlegs with respect to the roller presses at the ends of the row of presses becomes flatter and flatter. However, this is not acceptable for reasons of operational reliability; after all, the angle of the feedlegs to the vertical should be no more than about 30° in practice in order to ensure flawless delivery of the directly reduced iron to the roller presses. An arrangement in two rows is therefore preferred, particularly if more than a total of three presses are provided.

According to the invention, a cooling conveyor is associated with each of the two rows of presses, so that, during normal operation, the material of the first row of presses is delivered to one cooling conveyor (for example the first cooling conveyor) and the material of the second row of presses is delivered to the other cooling conveyor (for example the second cooling conveyor). But now the diverters provided according to the invention enable a variable operating mode, particularly in the event of a malfunction. If one of the cooling conveyors breaks down, the possibility exists for the diverters to deliver both the material of the first row of presses and the material of the second row of presses to just one of the cooling conveyors, that is, either to the first cooling conveyor or the second cooling conveyor. To increase operational reliability, the two cooling conveyors are each designed such that they can individually pick up and transport away all of the material of the installation. Consequently, the cooling conveyors are adapted to the overall capacity of the installation. It is advantageous if each cooling conveyor individually can pick up more than the material of a single row of presses. That way, overall production can be continued with both rows of presses even if one of the cooling conveyors malfunctions, since the cooling conveyor that is still in operation is dimensioned such that all of the material can be conveyed away.

It is advantageous if the row of presses or each row of presses has at least two roller presses, preferably three roller presses. In the case of several rows of presses, it also lies within the scope of the invention if the rows of presses have a different number of roller presses, for example the first row of presses has three roller presses and the second row of presses has four roller presses, it is advantageous if two roller presses, one being from the first row of presses and the other from the second row of presses, are in pairs next to one another. According to another proposal of the invention, a provision is made that screens are beneath the roller presses for separating off fine components ("hot fines"), it being possible to return this fine fraction to the briquette presses using one or more transport means. The diverters, in turn, are below the screens. Transport means are inherently known; they can be so-called "bucket conveyors." In this regard, the invention proposes that these transport means, for example bucket conveyors, be preferably arranged between the rows of presses. To wit, it is expedient if at least one transport means, for example a bucket conveyor, is arranged between two respective roller presses arranged in pairs next to one another.

According to the invention, the arrangement is very safe since the cooling of the material is ensured even if one of the cooling conveyors malfunctions. Wasteful emergency disposal, which would be conceivable in principle, can thus be eliminated.

In a preferred development, an installation is created that is characterized by a high production capacity and availability with a compact construction. The installation is characterized, among other things, by a low tower height, because, due to the arrangement of the presses in two rows, relatively short feedlegs can be used which are still at a sufficiently steep angle. Moreover, sufficient space exists between the individual machines for escape routes, and there is sufficient space to open the roller presses to replace the rolls or perform other maintenance work. Another advantageous aspect in this regard is the fact that the individual roller presses can all be constructed identically and also in identical orientation in the rows of presses. No special adaptations or "mutual orientation" of adjoining presses is necessary, thus further simplifying handling and maintenance. The availability of the installation is also improved by virtue of the fact that not only the presses, but also the cooling is redundant.

BRIEF DESCRIPTION OF THE DRAWING

The invention is described in further detail below with reference to a schematic drawing showing only one embodiment and in which.

SPECIFIC DESCRIPTION OF THE INVENTION

Figure 1:
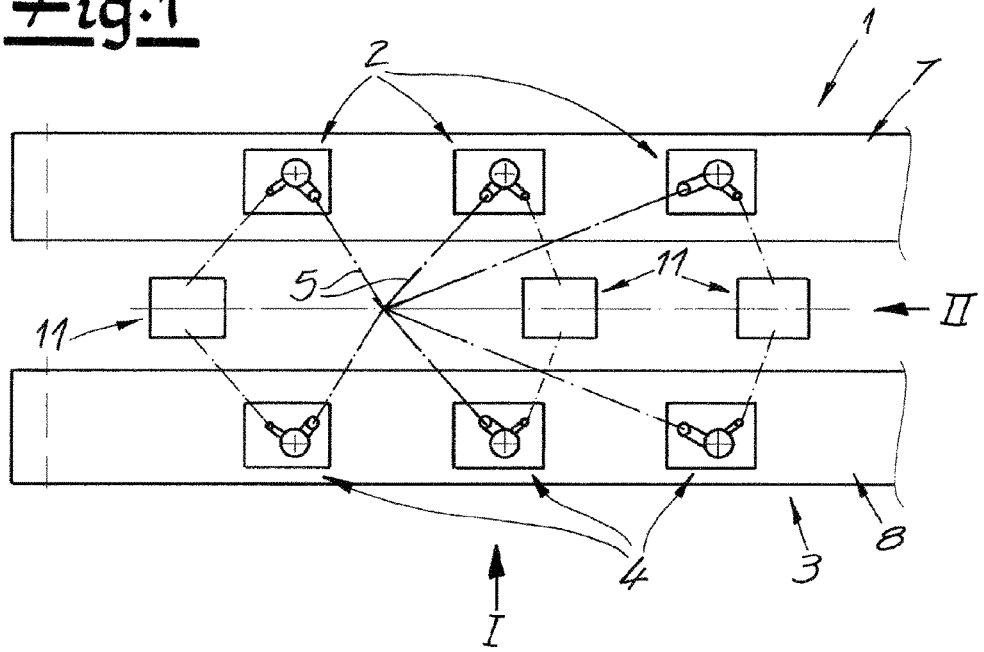
FIG. 1 is a simplified top view of an installation according to the invention for hot-briquetting directly reduced iron.

The drawing show a schematically simplified view of an installation for hot-briquetting directly reduced iron. The directly reduced iron is manufactured from pellets and/or lump ore, with the direct reduction being performed using gas. The drawing does not illustrate details of the manufacture of the directly reduced iron. The directly reduced iron is inputted in the direction of arrow X.

The installation for hot-briquetting illustrated in the Drawing has a first row 1 of presses with several first roller presses 2 and a second row 3 of presses with several roller presses 4. The directly reduced iron is inputted in the direction X through supply conduits 5 also referred to as "feedlegs." A comparison of FIGS. 2 and 3 shows that a feedleg 5 is provided for each roller press. In this embodiment, the first row of presses 1 has three successively aligned roller presses 2, and the second row of presses 3 also has three successively aligned roller presses 4. The directly reduced iron is pressed into briquettes in the roller presses 2 and 4. The possibility exists for individual briquettes to emerge directly from the roller presses 2 and 4. However, it is common for a string of connected briquettes to initially emerge from the roller presses 2 and 4 and for the briquettes to be separated beneath each of the roller presses by a suitable respective cutter 12. The material (briquettes in the illustrated embodiment) then travels through several material conduits 6 to cooling conveyors 7 and 8 beneath the roller presses 2 and 4. In this embodiment according to FIGS. 1 to 3, the first cooling conveyor 7 is beneath the first row of presses 1, and the second cooling conveyor 8 is beneath the second row of presses 3. According to the invention, the material conduits 6 are equipped with diverters 9. They are embodied and integrated into the material conduits 6 such that the briquettes can be delivered from the first press row 1 optionally to the first cooling conveyor 7 or to the second cooling conveyor 8. Likewise, the briquettes from the second press row 3 can be optionally delivered to the second cooling conveyor 8 or to the first cooling conveyor 7.

During normal operation, the installation is operated such that the material from the roller presses 2 of the first row of presses 1 is delivered to one cooling conveyor, the first cooling conveyor 7, and the material from the roller presses 4 of the second press row 3 is delivered to the other cooling conveyor, the second cooling conveyor 8.

If one of the cooling conveyors 7 and 8 malfunctions, the diverters 9 can be switched, particularly such that all of the material both from the roller presses 2 of the first press row 1 and from the roller presses 4 of the second press row 3 is then delivered to only one cooling conveyor, for example the first cooling conveyor 7 or, alternatively, the second cooling conveyor 8, depending on which conveyor is operational. The installation according to the invention is therefore characterized by a high level of failure safety, since it ensures that, even in case of the failure of one cooling conveyor, the hot material is transported away flawlessly without the need for a system shutdown or emergency disposal.

Figure 2:
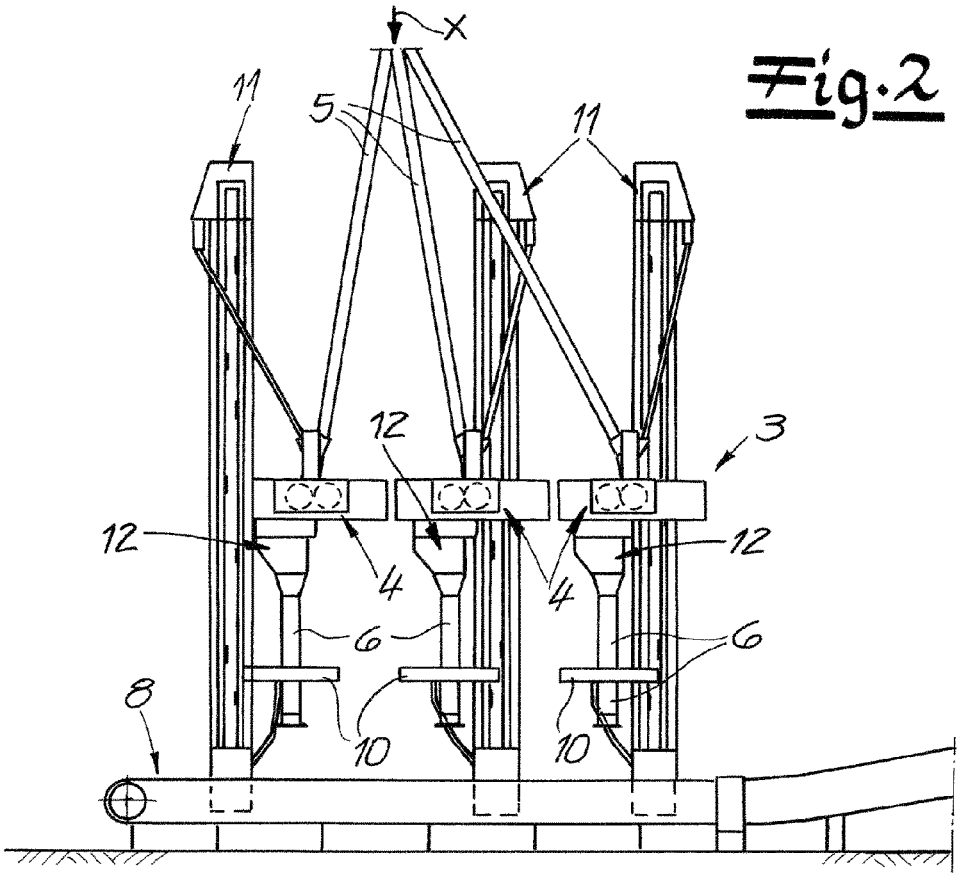
FIG. 2 shows the installation according to FIG. 1 in a simplified view from the direction of arrow A.
Figure 3:
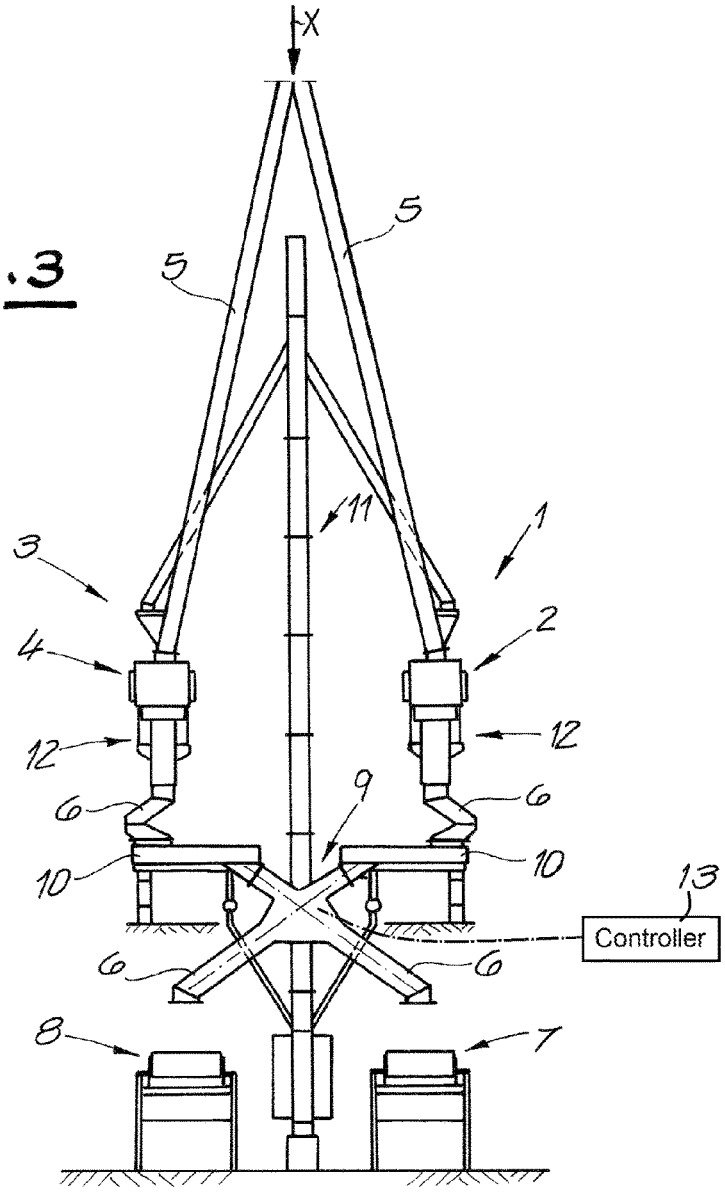
FIG. 3 shows the installation according to FIG. 1 in a simplified view from the direction of arrow B.

FIGS. 1 to 3 illustrate an embodiment in which two adjacent roller presses 2 and 4 are associated with a common respective diverter 9. In the illustrated embodiment, the diverter is X-shaped (see FIG. 3). Alternatively, it lies within the scope of the invention for more than two roller presses to be connected to a respective one of the diverters. For instance, two pairs of roller presses and, consequently, a total of four roller presses can be connected to a respective one of the diverters. This embodiment is not shown in the figures.

Moreover, it can be seen in the drawing that respective screens 10 for separating out a fraction of fine components can be beneath the roller presses 2 and 4. This fine fraction can then be conveyed back to the roller presses by transport means 11. The diverters 9 are beneath the screens. As can be seen in FIG. 3, the screens 10 are inserted into the material conduits 6. The material thus travels from a respective roller press 2 or 4 over the separator 12 into an upstream portion of the material conduit 6 and from there onto the screen 10 and then into an intermediate portion of the material conduit 6. This is then followed by the diverter 9 and, in turn, a downstream portion of the material conduit 6. In the illustrated embodiment, the transport means 11 are bucket conveyors. The drawing shows that these bucket conveyors 11 are between the rows of presses 1, 3. Two respective roller presses are associated with a respective common transport means 11, so that each transport means 11 is positioned between two adjacent roller presses.

Figure 4:
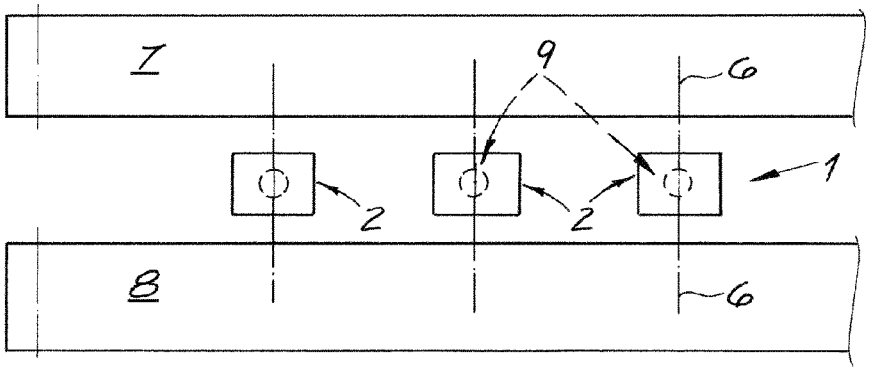
FIG. 4 is a simplified view of a modified embodiment of the invention.

FIG. 4 shows a modified embodiment of the invention in which the roller presses 2 are alined in only a single press row 1. Two cooling conveyors 7 and 8 are beneath this single press row 1. As in the embodiment according to FIGS. 1 to 3, the material travels from the roller presses 2 via material conduits 6 to the cooling conveyors 7 and 8. Diverters are, in turn, integrated into the material conduit 6, so that the material can be delivered from the roller presses 2 optionally to the first cooling conveyor 7 or to the second cooling conveyor 8. This embodiment, too, is therefore characterized by an increased level of operational reliability since, if one cooling conveyor fails, the material can be picked up by the other cooling conveyor. In this embodiment, the diverters 9 are Y-diverters. Details are not shown.

Moreover, the invention optionally also includes embodiments with more than two rows of presses and/or more than two cooling conveyors. For instance, three (or more) rows of presses having three (or more) cooling conveyors beneath them can be provided. Such an embodiment is not shown in the figures.

The invention claimed is:

1. A hot-briquetting or hot-compacting installation for directly reduced iron, the installation comprising:

a first row with at least one roller press supply means for feeding the directly reduced iron to the press for compaction thereby into briquettes;

a first cooling conveyor and a second cooling conveyor beneath the row;

a material conduit having an upstream end connected to the roller press and receiving briquettes therefrom and having respective first and second downstream ends for delivering the briquettes to the cooling conveyors; and a diverter in the material conduit operable to deliver the material from the roller press to the first cooling conveyor or to the second cooling conveyor; and a second row of at least one roller press, the first cooling conveyor being beneath the first press row and the second cooling conveyor beneath the second press row, the diverter being switchable such that the material can be delivered from the roller press of the first press row and/or from the roller press of the second press row to the first cooling conveyor or to the second cooling conveyor.

2. The installation defined in claim 1, wherein the first press row has a plurality of the roller presses in a straight line, and the second press row has a respective plurality of the roller presses in a straight line.

3. The installation defined in claim 2, wherein each roller press of the first press row is laterally adjacent and paired with a respective roller press of the second press row and each roller press from the first press row on the one hand and the respective paired roller press from the second press row on the other hand are connected to respective upstream ends of the material conduit and therethrough to the diverters.

4. The installation defined in claim 2, wherein more than two roller presses are connected to the diverter.

5. The installation defined claim 1, wherein the cooling conveyors are each designed and adapted to the total capacity of the roller presses such that, during operation, they can each receive and transport the material from all of the presses.

6. A hot-briquetting or hot-compacting installation for directly reduced iron, the installation comprising:

a first row with at least one roller press supply means for feeding the directly reduced iron to the press for compaction thereby into briquettes;

a first cooling conveyor and a second cooling conveyor beneath the row;

a material conduit having an upstream end connected to the roller press and receiving briquettes therefrom and having respective first and second downstream ends for delivering the briquettes to the first and second cooling conveyors;

a diverter in the material conduit operable to deliver the material from the roller press to the first cooling conveyor or to the second cooling conveyor;

respective screens through which the material conduits pass for separating off fine components beneath the roller presses; and transport means connected to the screens for conveying the fine components to the roller presses, the diverters being beneath the screens.

7. The installation defined in claim 6, wherein two of the roller presses are associated with the transport means.

8. The installation defined in claim 7, wherein the transport means is between the roller presses and/or between the cooling conveyors.

9. The installation defined in claim 6, further comprising:

a second row of at least one roller press, the first cooling conveyor being beneath the first press row and the second cooling conveyor beneath the second press row, the diverter being switchable such that the material can be delivered from the roller press of the first press row and/or from the roller press of the second press row to the first cooling conveyor or to the second cooling conveyor.

* * * * *